US009597555B2

(12) United States Patent
Goto et al.

(10) Patent No.: US 9,597,555 B2
(45) Date of Patent: Mar. 21, 2017

(54) RACKET

(71) Applicant: Yonex Kabushiki Kaisha, Tokyo (JP)

(72) Inventors: Taketoshi Goto, Nagaoka (JP); Yosuke Yamanaka, Tokyo (JP)

(73) Assignee: Yonex Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/730,535

(22) Filed: Jun. 4, 2015

(65) Prior Publication Data

US 2015/0352411 A1 Dec. 10, 2015

(30) Foreign Application Priority Data

Jun. 5, 2014 (JP) ..... 2014-116617

(51) Int. Cl.

| | |
|---|---|
| ***A63B 51/00*** | (2015.01) |
| ***A63B 49/00*** | (2015.01) |
| ***A63B 49/02*** | (2015.01) |
| ***A63B 51/12*** | (2006.01) |

(52) U.S. Cl.

CPC ..... *A63B 51/12* (2013.01); *A63B 49/02* (2013.01); *A63B 49/022* (2015.10); *A63B 60/02* (2015.10); *A63B 60/42* (2015.10); *A63B 60/52* (2015.10); *A63B 2102/04* (2015.10)

(58) Field of Classification Search

CPC ..... A63B 49/00; A63B 49/02; A63B 49/027; A63B 49/0276; A63B 49/14; A63B 51/12; A63B 49/022; A63B 60/02; A63B 60/42; A63B 60/52; A63B 12/006; A63B 2102/04

USPC ..... 473/524, 546, 539

See application file for complete search history.

(56) References Cited

U.S. PATENT DOCUMENTS 4,200,285 A * 4/1980 Petitti, Jr. ..... A63B 49/04 473/437
4,314,699 A * 2/1982 Bayer ..... A63B 49/02 473/544
4,697,811 A 10/1987 Muroi
5,133,552 A * 7/1992 Feeney ..... A63B 59/0092 473/537

(Continued)

FOREIGN PATENT DOCUMENTS

EP 2 783 732 A1 10/2014
JP 2012-147846 A 8/2012

(Continued)

OTHER PUBLICATIONS

Extended Search Report, European Patent Application No. 15170057.2, Sep. 30, 2015.

*Primary Examiner* — Raleigh W Chiu
(74) *Attorney, Agent, or Firm* — Harness, Dickey & Pierce, P.L.C.

(57) ABSTRACT

Performance of a racket can be adjusted. A racket includes a grip, an annular frame that is provided with a plurality of through holes that penetrate from an inner circumferential face to an outer circumferential face, and a shaft that connects the grip and the frame in a shaft axis direction, the frame having a rear end side attachment part, on the outer circumferential face of the frame and on a side closer to the shaft in the shaft axis direction, where there is mounted a rear end side attachment to which a string tensely provided to the frame is routed, and the rear end side attachment being made of a material different from the frame.

6 Claims, 6 Drawing Sheets

(56) References Cited

U.S. PATENT DOCUMENTS

| | | | | |
|---|---|---|---|---|
| 5,350,173 | A * | 9/1994 | DiCerbo | A63B 59/0092 473/521 |
| 5,368,297 | A * | 11/1994 | Liu | A63B 49/14 473/539 |
| 5,762,570 | A * | 6/1998 | Shaw | A63B 59/0092 473/522 |
| 6,527,656 | B1 * | 3/2003 | Cheng | A63B 59/0092 473/539 |
| 7,217,203 | B2 * | 5/2007 | Takeuchi | A63B 51/10 473/521 |
| 7,285,062 | B2 * | 10/2007 | McMillan | A63B 49/02 473/524 |
| 8,206,248 | B2 * | 6/2012 | Iizawa | A63B 49/022 473/522 |
| 2007/0054761 | A1 * | 3/2007 | Lin | A63B 49/0276 473/546 |
| 2010/0331126 | A1 | 12/2010 | Iizawa et al. | |
| 2013/0316858 | A1 | 11/2013 | Yu | |

FOREIGN PATENT DOCUMENTS

| | | | |
|---|---|---|---|
| JP | 2013-132449 | A | 7/2013 |
| JP | 2013-132455 | A | 7/2013 |

* cited by examiner

RACKET

CROSS REFERENCE TO RELATED APPLICATIONS

The present application claims priority upon Japanese Patent Application No. 2014-116617 filed on Jun. 5, 2014, which is herein incorporated by reference.

BACKGROUND

Technical Field

The present invention relates to rackets.

Related Art

Badminton is a game which requires a shuttle to be hit and placed at a precise location with speed. For this reason badminton rackets with excellent performance have been developed.

Japanese Laid-open Application No. 2012-147846 discloses a badminton racket that has a carbon fiber composite prepreg including carbon nanotubes.

There is demand for a badminton racket having desirable properties to allow a player to hit and place the shuttle with precision and speed. This is not limited to badminton rackets; similar properties are desired for tennis rackets and the like. It would be useful if the player could adjust the properties of a racket.

SUMMARY

The present invention has been made in view of the above circumstances and an objective thereof is to enable adjustment of the properties of a racket.

A main aspect of the invention for achieving the above objective is a racket including a grip, an annular frame that is provided with a plurality of through holes that penetrate from an inner circumferential face to an outer circumferential face, and a shaft that connects the grip and the frame in a shaft axis direction, the frame having a rear end side attachment part, on the outer circumferential face of the frame and on a side closer to the shaft in the shaft axis direction, where there is mounted a rear end side attachment through which a string to be tensely provided to the frame is routed, and the rear end side attachment being made of a material different from the frame.

Other features of the present invention will be made clear through the present specification with reference to the accompanying drawings.

According to the racket of the present invention, a rear end side attachment of a material different from the frame can be mounted on the racket. This allows the shuttle to be hit with a restitution characteristic that differs for each different rear end side attachment installed. The rear end side attachment alters the restitution characteristic of the string under tension according to the material used. In other words, the player can adjust the properties of the racket by interchangeably installing different rear end side attachments of various materials. In this way, the rear end side attachment part, installed on the shaft side of the frame, adjusts the properties of the racket without sacrificing the ease of swing follow through.

BRIEF DESCRIPTION OF THE DRAWINGS

For a more complete understanding of the present invention and the advantages thereof, reference is now made to the following description taken in conjunction with the accompanying drawings wherein.

DESCRIPTION OF EXEMPLARY EMBODIMENTS

Figure 1A:
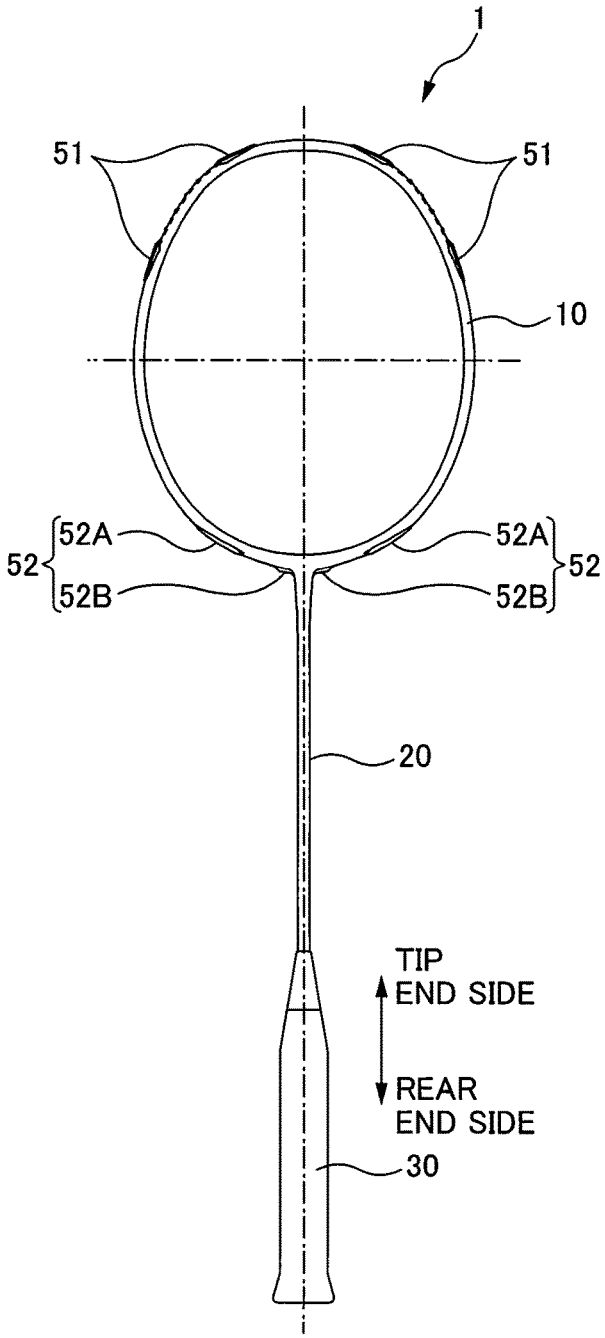
FIG. 1A is a planar view of a badminton racket 1 of one embodiment of the present invention.

At least the following matters will become clear through the description of the present specification and the accompanying drawings.

===Outline of the Disclosure===

From the description in this specification and the drawings, at least the following matters will become clear.

In other words, a racket includes:

a grip; an annular frame that is provided with a plurality of through holes that penetrate from an inner circumferential face to an outer circumferential face; and a shaft that connects the grip and the frame in a shaft axis direction, the frame having a rear end side attachment part, on the outer circumferential face of the frame and on a side closer to the shaft in the shaft axis direction, where there is mounted a rear end side attachment through which a string to be tensely provided to the frame is routed, and the rear end side attachment being made of a material different from the frame.

With such a racket, a rear end side attachment made of a material different from the frame can be mounted so that a shuttle can be hit with a restitution characteristic that differs from one rear end side attachment to another. In other words, a player can adjust the properties of the racket since rear end side attachments made of various materials can be exchangeably mounted. When so mounted, the rear end side attachment part is provided to the shaft side of the frame, thereby adjusting the properties of the racket without sacrificing the usability and the ease of swinging the racket.

Further, the racket has a rear end side grommet on the outer circumferential face of the frame and on the side closer to the shaft in the shaft axis direction, wherein the rear end side grommet is provided to a location that restricts a location of the rear end side attachment part.

In this way, the position where the rear end side attachment is to be mounted can be restricted to a predetermined location, since the rear end side grommet restricts the position of the rear end side attachment part. The mounting position of the rear end side attachment is determined at an appropriate position for each racket, so that the position of the rear end side attachment part can be restricted by arranging as above. In this way, the rear end side attachment can be mounted only to an appropriate position.

Furthermore, in the racket the rear end side grommet includes a first rear end side grommet and a second rear end side grommet. The rear end side attachment part is provided on the outer circumferential face of the frame and between the first rear end side grommet and the second rear end side grommet.

With such a racket, the position of the rear end side attachment part can be restricted to a location between a first rear end side grommet and a second rear end side grommet. The mounting position of the rear end side attachment is determined to an appropriate location depending on the racket, and in this way the position of the rear end side attachment part can be restricted so that the rear end side attachment can be mounted only to an appropriate location.

Moreover, the rear end side attachment part includes at least two through holes among the plurality of through holes and the at least two through holes are formed to allow protrusions inserted there through, the protrusions being at least two protrusions provided to the rear end side attachment and having a string inserted there through.

With such a racket, at least two protrusions of the rear end side attachment can be inserted through at least the two through holes of the rear end side attachment part. Furthermore, a string can be inserted through the at least two protrusions provided to the rear end side attachment so that the attachment on the through hole side can be appropriately fixed to the attachment part on the through hole side. The reaction force from the rear end side attachment is reflected on the taut string spanning the through holes of the at least two protrusions. In this way, the reaction force can be varied by changing the material of the rear end side attachment to another one, and therefore the racket properties can be easily varied by changing the rear end side attachment.

Still further, the frame of the racket has a tip end side attachment part, on the outer circumferential face of the frame and on a side opposite the side closer to the shaft in the shaft axis direction, where there is mounted a tip end side attachment through which a taut string is routed, where the tip end side attachment is made of a material different from the frame.

In such a racket, a tip end side attachment is further mounted to allow adjustment of the racket properties, particularly to increase the power and speed of a smash. Further, although the usability of a racket may decrease when only the tip end side attachment is mounted, the above racket having the rear end side attachment mounted will not lose its usability while the power and speed of a smash can be increased as well.

Still further, the racket has a tip end side grommet on the outer circumferential face of the frame and on the side opposite the side closer to the shaft in the shaft axis direction, wherein the tip end side grommet has the tip end side attachment part that defines the location where the tip end side attachment is to be mounted.

With such a racket, the grommet has a tip end side attachment part and the grommet defines the position where the tip end side attachment is to be mounted so that the position where the tip end side attachment is to be mounted can be restricted to an appropriate location.

Still further, in such racket, the tip end side grommet includes an engagement part that restricts a movement of the tip end side attachment in a circumferential direction of the frame. Accordingly, the tip end side grommet has an engagement part that limits the movement of the tip end side attachment along the circumferential direction of the frame so that the tip end side attachment can be restrained from moving.

===Badminton Racket 1===

Figure 1B:
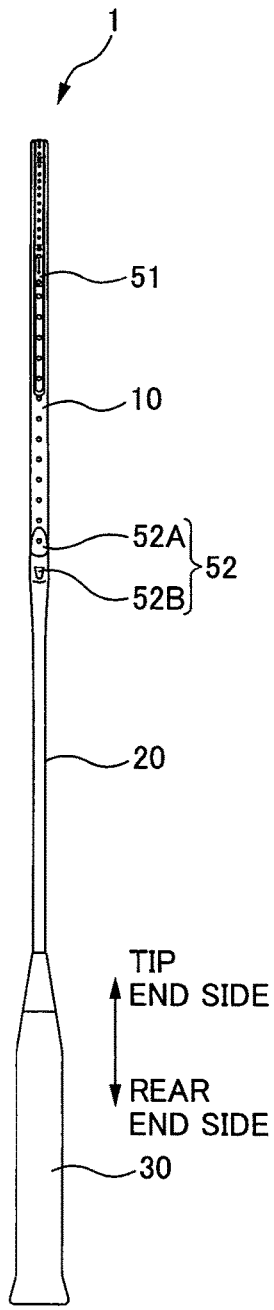
FIG. 1B is a side view of a badminton racket 1 of the present embodiment.

FIG. 1A is a planar view of a badminton racket 1 according to the present embodiment. FIG. 1B is a side view of the badminton racket 1 according to the present embodiment. The badminton racket 1 (hereinafter may be called simply "racket 1") includes an annular frame 10, a shaft 20 and a grip 30. The shaft 20 connects the annular frame 10 and the grip 30. The frame 10 and the shaft 20 are produced by molding, for example, carbon fiber.

The racket 1 exhibits a left-right symmetrical shape. Therefore, explanation is given here for only one of the left and the right parts. The frame 10 of the racket 1 has mounted thereto a tip end side grommet 51 and a rear end side grommet 52. The tip end side grommet 51 is a grommet which is mounted on the tip end side with respect to the center of the frame 10. The rear end side grommet 52 is a grommet which is mounted on the rear end side (shaft side) with respect to the center of the frame 10.

The tip end side grommet 51 may be seen as being composed of two grommets when referring to FIG. 1A; however, this is merely a result of the particular illustrated view. That is, part of the tip end side grommet 51 is not visible in the front view since the tip end side grommet 51 is fit into the recessed part provided to the outer circumference of the frame 10, and is actually composed of a single grommet as illustrated in FIG. 1B. In other words, the racket 1 has a total of two tip end side grommets 51 mounted on the left and the right sides.

Further, the rear end side grommets 52 each include a first rear end side grommet 52A and a second rear end side grommet 52B. The first rear end side grommet 52A is a rear end side grommet which is provided on the tip end side, along the shaft axis direction relative to the second rear end side grommet 52B. The second rear end side grommet 52B is a grommet which is provided to a location closer to the shaft 20.

Figure 2:
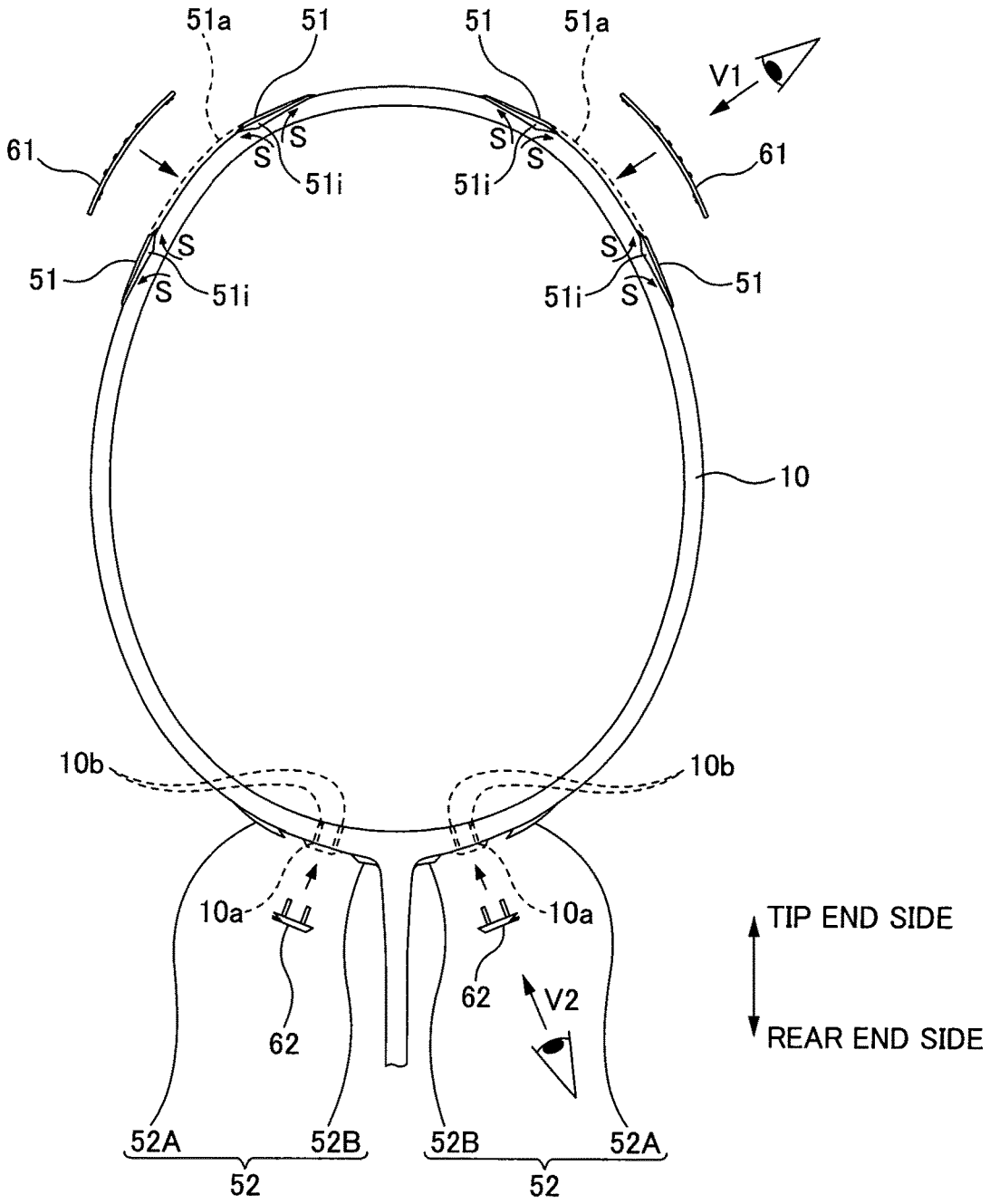
FIG. 2 is an enlarged view of a frame 10 of the badminton racket 1.

FIG. 2 is an enlarged view of the frame 10 of the badminton racket 1. FIG. 2 illustrates an enlarged front view of the frame 10. Further, the tip end side grommet 51 and the rear end side grommet 52 (including the first rear end side grommet 52A and the second rear end side grommet 52B) mounted to the frame 10 are also illustrated. FIG. 2 further illustrates the tip end side weight variable component 61 and the rear end side weight variable component 62.

The tip end side grommet 51 of the racket 1 has a tip end side weight variable component attachment part 51*a* provided thereto. The racket 1 also has a rear end side weight variable component attachment part 10*a* provided thereto. The tip end side weight variable component attachment part 51*a* has the tip end side weight variable component 61 mounted thereto. The rear end side grommet 52 also has the rear end side weight variable component 62 mounted thereto.

In the front view of the frame 10 illustrated in FIG. 2, the tip end side grommet 51 is formed with a thickness such that the height thereof gradually increases when approaching from the end sides (tip end side, rear end side) of the tip end side grommet 51 toward the tip end side weight variable component attachment part 51*a*. When the tip end side weight variable component 61 is attached to the tip end side weight variable component attachment part 51*a*, the height difference of the tip end side weight variable component attachment part 51*a* at the tip end side grommet 51 is nearly eliminated, as shown by the dashed line in the front view of the frame 10 illustrated in FIG. 2. In other words, the tip end side grommet 51 and the tip end side weight variable component 61 are made integral, so that the frame 10 in the circumferential direction has a substantially continuous form with no height difference. Forming in this way, with an extremely small height difference, minimizes air resistance when swinging the racket 1.

Further, as in the front view of the frame 10 illustrated in FIG. 2, the first rear end side grommet 52A is also formed with a thickness such that the height thereof gradually increases when approaching toward the rear end side weight variable component attachment part 10*a*. Additionally, as in the front view of the frame 10 illustrated in FIG. 2, the second rear end side grommet 52B is also formed with a thickness such that the height thereof gradually increases when approaching toward the rear end side weight variable component attachment part 10*a*.

When the rear end side weight variable component 62 is attached to the rear end side weight variable component attachment part 10*a*, the height difference between the rear end side grommet 52 (the first rear end side grommet 52A and the second rear end side grommet 52B) and the rear end side weight variable component attachment part 10*a* is nearly eliminated, so that a form with a small height difference can be made to the circumferential direction of the frame 10, in the front view of frame 10 in FIG. 2. Forming in this way, with a small height difference, minimizes air resistance when swinging the racket 1.

Further, FIG. 2 illustrates a substantially triangular part 51*i* in the tip end side grommet 51. As illustrated in FIG. 2, the substantially triangular part 51*i* has a shape where the bottom side thereof comes along the external circumferential diameter of the of the frame 10 and the apex thereof is provided on an inner side of the frame 10 with respect to the external circumferential diameter of the frame 10. In this way, when the racket is swung, air flows through in the direction shown by reference symbol S, from the apex of the substantially triangular part 51*i* and along the sides beside the bottom side of the substantially triangular part 51*i*. In this way, the air resistance can be minimized when the racket is swung.

Figure 3A:
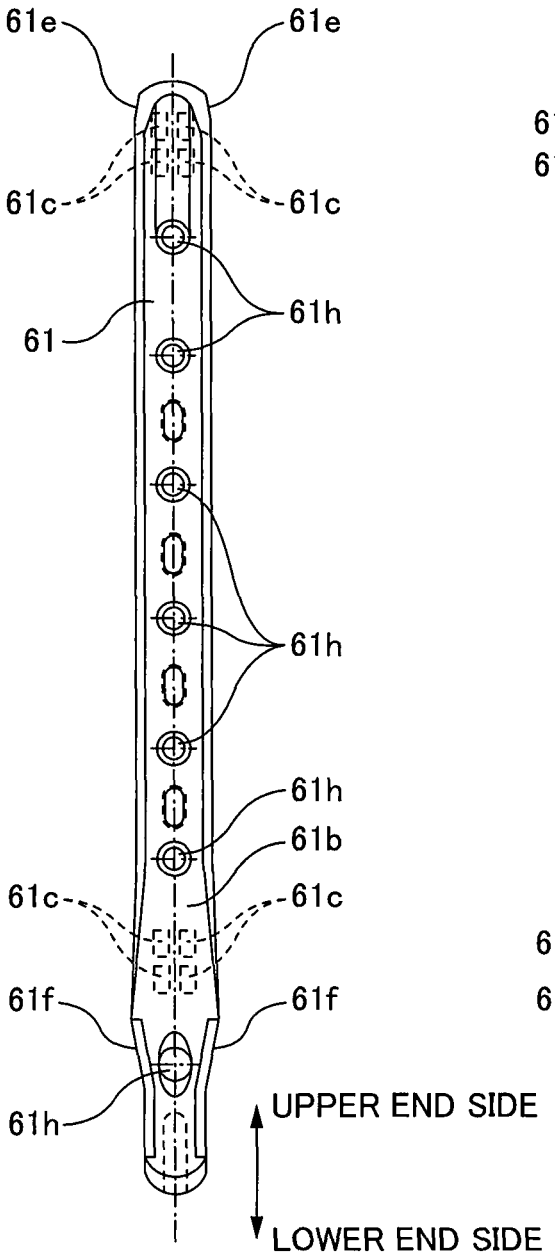
FIG. 3A is a planar view of the tip end side weight variable component 61.
Figure 3B:
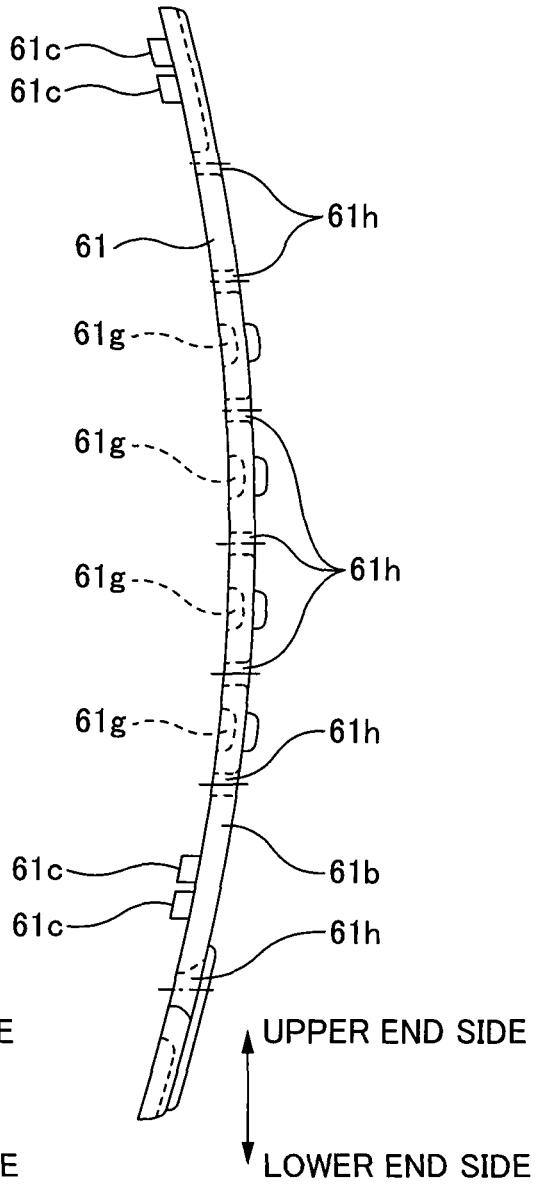
FIG. 3B is a side view of the tip end side weight variable component 61.

FIG. 3A is a planar view of the tip end side weight variable component 61. FIG. 3B is a side view of the tip end side weight variable component 61. Description of each parts of the tip end side weight variable component 61 will be given in the following with reference to these drawings.

As illustrated in FIG. 3B, the tip end side weight variable component 61 has a curved tip end side weight variable component base part 61*b* so as to come along the tip end side grommet 51. Four tip end side weight variable component protrusion parts 61*c* protrude from the upper end side (upper side in FIG. 3B) of the tip end side weight variable component base part 61*b*. Additionally, four tip end side weight variable component protrusion parts 61*c* protrude from the lower end side (lower side in FIG. 3B) of the tip end side weight variable component base part 61*b*. A total of eight of these tip end side weight variable component protrusion parts 61*c* protrude toward the inner side of the curve of the tip end side weight variable component base part 61*b* and are inserted into the later described grommet side protrusion insert parts 51*c*.

Further, four tip end side weight variable component recessed parts 61*g* are formed on the inner side of the curved tip end side weight variable component base part 61*b* between the four tip end side weight variable component protrusion parts 61*c* on the upper end side and the four tip end side weight variable component protrusion parts 61*c* on the lower end side. The four tip end side weight variable component recessed parts 61*g* has the later described grommet side protrusion parts 51*g* inserted.

There is a tip end side weight variable component insert hole 61*h* between each of the four tip end side weight variable component recessed parts 61*g*. Additionally, there are two tip end side weight variable component insert holes 61*h* between the tip end side weight variable component protrusion parts 61*c* on the upper end side and the tip end side weight variable component recessed part 61*g* on the side closest to the upper end. In addition, there is a tip end side weight variable component insert hole 61*h* between the tip end side weight variable component recessed part 61*g* on the side closest to the lower end and the tip end side weight variable component protrusion part 61*c* on the lower end side. Moreover, there is a tip end side weight variable component insert hole 61*h* on the lower end side of the lower end side tip end side weight variable component protrusion parts 61*c*.

Further as illustrated in FIG. 3A, the tip end side weight variable component 61 includes two tip end side weight variable component upper end inclined parts 61*e* on the tip end side of the tip end side weight variable component base part 61*b*. Furthermore, the tip end side weight variable component 61 includes two tip end side weight variable component lower end inclined parts 61*f* on the lower end side of the tip end side weight variable component base part 61*b*. The tip end side weight variable component upper end inclined parts 61*e* and the tip end side weight variable component lower end inclined parts 61*f* are made to come into contact with the upper side inclined grommet part 51*e* and the lower side inclined grommet part 51*f*, respectively, as will be described later.

Figure 4A:
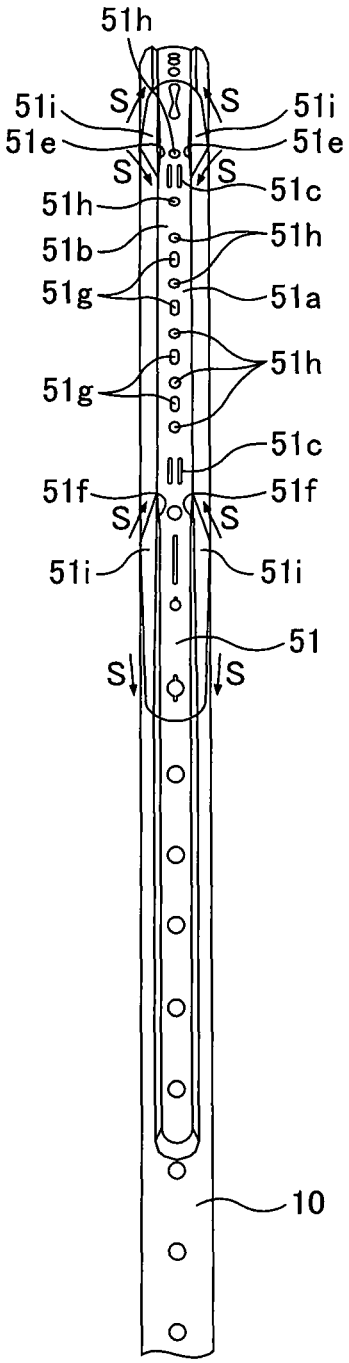
FIG. 4A is a partially enlarged view of the frame 10 before having the tip end side weight variable component 61 mounted.
Figure 4B:
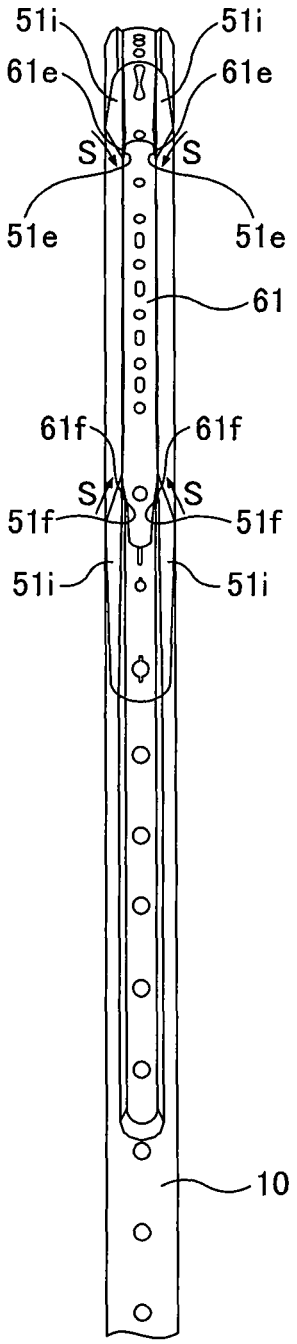
FIG. 4B is a partially enlarged view of the frame 10 having the tip end side weight variable component 61 mounted.

FIG. 4A is a partially enlarged view of the frame 10 before having the tip end side weight variable component 61 mounted. FIG. 4B is a partially enlarged view of the frame 10 having the tip end side weight variable component 61 mounted. Both FIGS. 4A and 4B are views of the frame 10 seen from the angle of V1 illustrated in the aforementioned FIG. 2. FIG. 4A illustrates the frame 10 and the tip end side grommet 51. Further, FIG. 4B illustrates the tip end side weight variable component 61.

The tip end side grommet 51 includes a plurality of protrusions, not shown. The plurality of protrusions each have insert holes through which a string can be inserted. The combination of the pitches of the plurality of protrusions arranged to the tip end side grommet 51 matches the combination of the pitches of the insert holes arranged at a specific location in the frame 10. In this way, the tip end side grommet 51 can be mounted only to a specific location on the frame 10.

As illustrated in FIG. 4A, the tip end side grommet 51 includes a tip end side grommet base part 51*b* which is curved for mounting to the frame 10. The outer circumferential side of the tip end side grommet base part 51*b* has a tip end side weight variable component attachment part 51*a* which is a part where the aforementioned tip end side weight variable component 61 is attached. The position of the tip end side weight variable component attachment part 51*a* is defined by the grommet side protrusion insert parts 51*c*, the grommet side protrusion parts 51*g*, the upper side inclined grommet part 51*e* and the lower side inclined grommet part 51*f*.

Further, the tip end side grommet 51 includes the grommet side protrusion insert parts 51*c* at two locations on the upper end side of the tip end side grommet base part 51*b*. The grommet side protrusion insert parts 51*c* are formed such that each can have two tip end side weight variable component protrusion parts 61*c* inserted therein. When the two tip end side weight variable component protrusion parts 61*c* are inserted into a single grommet side protrusion insert part 51*c*, each of the two tip end side weight variable component protrusion parts 61*c* slightly elastically deforms such that the two come close to each other, allowing insertion into the single grommet side protrusion insert part 51*c*. The tip end side weight variable component 61 is fixed to the tip end side grommet 51 by this elastic force.

Furthermore, the tip end side grommet 51 includes two grommet side protrusion insert parts 51*c* at also the bottom end side of the tip end side grommet base part 51*b*. In this case as well, the grommet side protrusion insert parts 51*c* are formed such that each can have the two tip end side weight variable component protrusion parts 61*c* inserted therein. When the two tip end side weight variable component protrusion parts 61*c* are inserted into a single grommet side protrusion insert part 51*c*, each of the two tip end side weight variable component protrusion parts 61*c* slightly elastically deforms such that the two come close to each other, allowing insertion into the single grommet side protrusion insert part 51*c*.

The tip end side grommet base part 51*b* has four grommet side protrusion parts 51*g* between the two grommet side protrusion insert parts 51*c* on the upper end side and the two grommet side protrusion insert parts 51*c* on the lower end side. These four grommet side protrusion parts 51*g* are each inserted into the tip end side weight variable component recessed part 61*g*.

A grommet side insert hole 51*h* is formed to each space between the four grommet side protrusion parts 51*g*. The two grommet side through holes 51*h* are formed between the grommet side protrusion insert parts 51*c* on the upper end side and the grommet side protrusion part 51*g* closest to the upper end. Further, a grommet side through hole 51*h* is formed between the grommet side protrusion part 51*g* closest to the lower end and the grommet side protrusion insert parts 51*c* on the lower end side.

Further, as illustrated in FIG. 4A, the tip end side grommet 51 includes two grommet upper side inclined parts 51*e* on the tip end side of the tip end side grommet base part 51*b*. Furthermore, the tip end side grommet 51 includes two grommet lower side inclined parts 51*f* on the lower end side of the tip end side grommet base part 51*b*.

The positions of the grommet side protrusion insert parts 51*c* and the positions of the grommet side protrusion parts 51*g* in the tip end side grommet 51, described above, match the positions of the tip end side weight variable component protrusion parts 61*c* and the positions of the tip end side weight variable component recessed parts 61*g* in the tip end side weight variable component 61 which is to be mounted. Therefore, the grommet side protrusion parts 51*g* are appropriately inserted into the tip end side weight variable component recessed parts 61*g* when the tip end side weight variable component protrusion parts 61*c* are inserted to the grommet side protrusion insert parts 51*c*.

The position of the grommet side insert hole 51*h* of the tip end side grommet 51 and the position of the tip end side weight variable component insert hole 61*h* of the tip end side weight variable component 61 now approximately match. Therefore, a string can be inserted through the grommet side insert hole 51*h* and the tip end side weight variable component insert hole 61*h* which have the positions of the holes matching, and the two can be appropriately fixed using the tensile force of the string. At this time, the tip end side weight variable component insert hole 61*h* has a so-called main string (the string which is strung in the direction along the shaft axis direction) and a cross string (the string which is strung in the direction intersecting the main string) inserted there through. Note that, different from the above, the later described rear end side weight variable component protruding parts 62*c* of the rear end side weight variable component 62 has only the main string inserted there through.

When the string is tightened, the string pushes the tip end side weight variable component 61 against the tip end side weight variable component attachment part 51*a*. The string then applies the reaction force through the tip end side weight variable component 61. Since the reaction force differs depending on the material of the tip end side weight variable component 61, the performance such as the feel and the like when hitting with the racket can be varied by changing the material of the tip end side weight variable component 61 to another one.

Further, when the tip end side weight variable component 61 is mounted to the tip end side grommet 51, the tip end side weight variable component upper end inclined parts 61*e* come into contact with the upper side inclined grommet part 51*e*, and the tip end side weight variable component lower end inclined parts 61*f* come into contact with the lower side inclined grommet part 51*f*.

As illustrated in FIG. 4A, the upper side inclined grommet part 51*e* in the tip end side grommet 51 is slightly inclined with regard to the shaft axis direction and the inclination angle substantially matches the inclination angle of the tip end side weight variable component upper end inclined parts 51*e* when the tip end side weight variable component 61 is mounted to the tip end side grommet 51. Additionally, the lower side inclined grommet part 51*f* in the tip end side grommet 51 is also slightly inclined with regard to the shaft axis direction and the inclination angle substantially matches the inclination angle of the tip end side weight variable component lower end inclined parts 61*f* when the tip end side weight variable component 61 is mounted to the tip end side grommet 51.

When carried out in the above manner, the upper side inclined grommet part 51*e* and the lower side inclined grommet part 51*f* respectively engages the tip end side weight variable component upper end inclined parts 61*e* and the tip end side weight variable component lower end inclined parts 61*f* to limit the movement of the tip end side weight variable component 61 with regard to the tip end side grommet 51. Therefore, the tip end side weight variable component 61 can be restrained from moving even during the impact imparted when hitting a shuttle.

Further as mentioned above, since the tip end side grommet 51 has a tip end side weight variable component attachment part 51*a* that defines the position where the tip end side weight variable component 61 is to be mounted, the position where the tip end side weight variable component 61 is to be mounted can be restricted to an appropriate location.

Furthermore, FIGS. 4A and 4B illustrate the substantially triangular part 51*i*. FIGS. 4A and 4B indicate the flow S of air when the racket 1 is swung. As in the aforementioned description, the tip end side grommet 51 includes the substantially triangular part 51*i* so that air flows in the direction indicated by reference symbol S in FIG. 4A when the racket 1 is swung, even when the tip end side weight variable component 61 is not attached. In other words, the air resistance can be minimized when swinging the racket 1 since air can be appropriately released.

Even furthermore, when the tip end side weight variable component 61 is attached as illustrated in FIG. 4B, the tip end side weight variable component 61 itself will not interfere with the flow of the air indicated by the reference symbol S since the tip end side weight variable component 61 is positioned at a location between the substantially triangular part 51*i* on one face side of the frame 10 and the substantially triangular part 51*i* on the other face side. Hereby, the air resistance when the racket 1 is swung can be minimized.

Figure 5A:
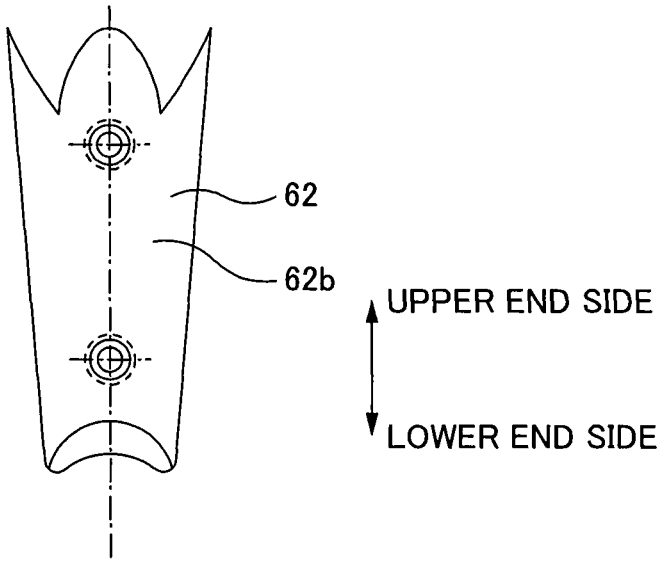
FIG. 5A is a planar view of the rear end side weight variable component 62.
Figure 5B:
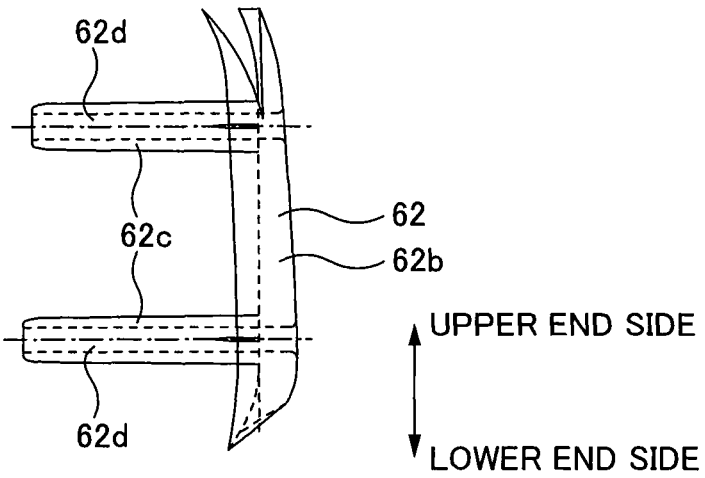
FIG. 5B is a side view of the rear end side weight variable component 62.

FIG. 5A is a planar view of the rear end side weight variable component 62. FIG. 5B is a side view of the rear end side weight variable component 62. The rear end side weight variable component 62 includes a rear end side weight variable component base part 62*b* and rear end side weight variable component protruding parts 62*c*. The rear end side weight variable component base part 62*b* is a portion that comes into intimate contact with the outer circumference of the frame 10 when the rear end side weight variable component 62 is mounted to the frame 10, and the rear end side weight variable component protruding parts 62*c* are portions that are inserted to the insert holes 10*b* of the later described rear end side weight variable component attachment part 10*a*.

Figure 6A:
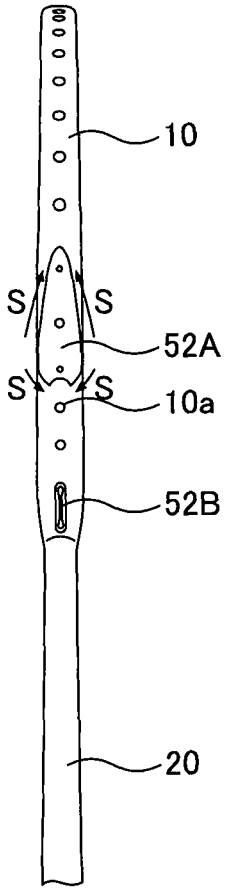
FIG. 6A is a partially enlarged view of the frame 10 before having the rear end side weight variable component 62 mounted.
Figure 6B:
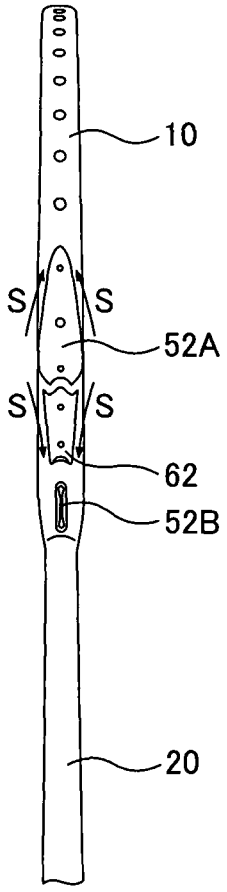
FIG. 6B is a partially enlarged view of the frame 10 having the rear end side weight variable component 62 mounted.

FIG. 6A is a partially enlarged view of the frame 10 before having the rear end side weight variable component 62 mounted. FIG. 6B is a partially enlarged view of the frame 10 having the rear end side weight variable component 62 mounted. FIGS. 6A and 6B are both views of the frame 10 seen from the aforementioned angle of V2 illustrated in FIG. 2. FIG. 6A illustrates the frame 10, the first rear end side grommet 52A and the second rear end side grommet 52B. FIG. 6B further illustrates the rear end side weight variable component 62.

The first rear end side grommet 52A includes a plurality of protrusions not shown. The plurality of protrusions is provided with a through hole through which a string can be inserted. Further, the second rear end side grommet 52B also includes a plurality of protrusions not shown. The plurality of protrusions is also provided with a through hole through which a string can be inserted.

The plurality of protrusions of the first rear end side grommet 52A is allowed to be mounted to only a predetermined location of the frame 10 with the limitations by the pitch of the protrusions and the diameter of the through holes provided to the frame 10. Additionally, in a similar manner, the plurality of protrusions of the second rear end side grommet 52B is allowed to be mounted to only a predetermined location of the frame 10 with the limitations by the pitch of the protrusions and the diameter of the through holes provided to the frame 10.

The first rear end side grommet 52A and the second rear end side grommet 52B define the position of the rear end side weight variable component attachment part 10*a* where the rear end side weight variable component 62 is to be mounted. The rear end side weight variable component attachment part 10*a* is a part that is sandwiched between the first rear end side grommet 52A and the second rear end side grommet 52B on the outer circumferential face of the frame 10.

The rear end side weight variable component attachment part 10*a* includes through holes 10*b* at positions between the first rear end side grommet 52A and the second rear end side grommet 52B. The pitch between the two through holes 10*a* of the rear end side weight variable component attachment part 10*a* is equal to the pitch between the two rear end side weight variable component protruding parts 62*c*. The limitations by the pitches of the through holes of the frame 10 and the insert holes of the grommet, and the diameters of the through holes of the frame 10 and the insert holes of the grommet allow the rear end side weight variable component 62 to be mounted only to the rear end side weight variable component attachment part 10*a*. In other words, the two rear end side weight variable component protruding parts 62*c* can only be inserted through the two through holes 10*b*.

As can be seen in FIG. 6A, the first rear end side grommet 52A is in a form such that the width gradually decreases when approaching from the widest part toward the upper end side. Additionally, although including a depressed part on the lower end part, the first rear end side grommet 52A is also in a form such that the width gradually decreases when approaching from the widest part toward the lower end side. In this way, air flow as indicated with the reference symbol S can be created when swinging the racket 1 even when the rear end side weight variable component 62 is not mounted. In other words, air can be released thereby minimizing the air resistance.

Further, as illustrated in FIG. 6B, when the rear end side weight variable component 62 is attached, the width of the widest part of the first rear end side grommet 52A gradually decreases when approaching the rear end side weight variable component 62 as well as when approaching the second rear end side grommet 52B. Therefore, air flow as indicated with the reference symbol S can be created when swinging the racket 1. In other words, air can be released thereby minimizing the air resistance.

Figure 6C:
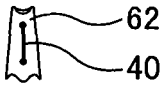
FIG. 6C is an explanatory view illustrating how the string 40 in the rear end side weight variable component 62 is strung.

FIG. 6C is an explanatory view illustrating how the string 40 in the rear end side weight variable component 62 is strung. A protrusion part insert hole 62*d* through which a string is inserted is provided to the rear end side weight variable component protruding parts 62*c*. When a string 40 is inserted through the protrusion part insert hole 62*d*, the string 40 is tightened across the two protrusion part insert holes 62*d*, as illustrated in FIG. 6C. In this way, the rear end side weight variable component 62 can be certainly fixed to the rear end side weight variable component attachment part 10*a*.

Since the string 40 is tightened in a manner pressing the rear end side weight variable component 62 against the rear end side weight variable component attachment part 10*a*, a reaction force from the rear end side weight variable component 62 acts on the string 40. Since the reaction force differs depending on the material of the rear end side weight variable component 62, the performance such as the feel and the like when hitting with the racket 1 can be varied by changing the material of the rear end side weight variable component 62 to another one. Note that, the same applies to the tip end side weight variable component 61.

As described above, the rear end side weight variable component 62 is made to be mounted to a location close to the shaft 20. Only the main string is inserted through the rear end side weight variable component 62. The main string at a location close to the shaft 20 is a string which is likely to affect the sweet spot of the racket 1. This makes it easy to vary the performance, such as the feel and the like when hitting with the racket 1, by changing the material of the rear end side weight variable component 62 to another one.

The rear end side weight variable component attachment part 10*a* being provided to the rear end side (on the shaft 20 side) of the frame 10, allows the rear end side weight variable component 62 to be mounted to the rear end side of the frame 10 so that the performance of the racket 1 can be adjusted without diminishing the ease of use and swing performance of the racket 1. Further, the location appropriate for the rear end side weight variable component 62 to be mounted is considered to be at the rear end side weight variable component attachment part 10*a* indicated in FIGS. 6A and 6B. Therefore in the present embodiment, as mentioned above, the first rear end side grommet 52A and the second rear end side grommet 52B are made to be mounted on the rear end side of the frame 10, and the tip end side weight variable component 61 is made to be mounted only between these two.

In this way, according the racket 1 of the present embodiment, the mounting position of the rear end side weight variable component 62 can be restricted to a predetermined location since the first rear end side grommet 52A and the second rear end side grommet 52B limit the location where the rear end side weight variable component attachment part 10*a* is to be mounted. The location where the rear end side weight variable component attachment part 10*a* is to be mounted being determined to an appropriate location depending on the racket 1, as described above, can restrict the position of the rear end side weight variable component attachment part 10*a* in the manner described above so that the rear end side weight variable component 62 is mounted only to an appropriate position.

Further as described above, according to the racket 1 of the present embodiment, the tip end side weight variable component 61 being attached on the tip end side of the frame 10 allows an adjustment to increase the performance of the racket, particularly the power and speed of a smash to be increased. Here, although the usage of the racket 1 may deteriorate if attaching only the rear end side weight variable component 62, since the tip end side weight variable component 61 can be attached to the rear end side of the frame 10, the racket 1 according to the present embodiment can increase the power and speed of a smash without losing the usability.

Next, description of the material of the tip end side weight variable component 61 and the rear end side weight variable component 62 will be given. For example, nylon and the like can be adopted as the material of the tip end side weight variable component 61 and the rear end side weight variable component 62. Additionally, an example of the tensile modulus of elasticity of the material adopted by the tip end side weight variable component 61 and the rear end side weight variable component 62 will be given in the following.

TABLE 1

| | tensile modulus of elasticity (MPa) |
|---|---|
| average elastic material | 1300 to 1800 |
| highly elastic material | 2000 to 2800 |

In this way, the tip end side weight variable component 61 and the rear end side weight variable component 62 made of different materials are prepared in advance and are appropriately selected for the racket 1 for replacement. Thus a racket 1 having introduced the characteristics of the tip end side weight variable component 61 and the rear end side weight variable component 62 with different tensile modulus of elasticity can be used. In other words, the racket 1 can be changed to have a different performance by replacing the tip end side weight variable component 61 with a tip end side weight variable component 61 of a different material. Further, the racket 1 can be changed to have a different performance by replacing the rear end side weight variable component 62 with a rear end side weight variable component 62 of a different material.

The feel when hitting a shuttle differs according to the difference in the performance of the racket 1. The initial velocity of the shuttle when hitting a smash would also differ. Therefore, a player can select and mount a tip end side weight variable component 61 and a rear end side weight variable component 62 to obtain the player's preferred feel, and can play using a racket 1 having the user's preferred performance.

Note that when the material used differs, the weight would differ as well. For example, a material weighing 0.2 to 0.4 grams can be adopted by a tip end side weight variable component 61. For example, a material weighing 0.2 to 0.3 grams can be adopted by a rear end side weight variable component 62.

Since the racket 1 according to the present embodiment has the weight variable components mounted to the rear end side, the performance of the racket 1 can be changed while dispersing the swing weight to maintain the ease of swinging the racket 1.

Further as illustrated in FIG. 2, when the tip end side weight variable component 61 is mounted to the tip end side grommet 51, these parts would form a streamline shape such that their outer circumferential faces are made integral. Hereby, the air resistance when swinging the racket 1 can be minimized. Further, the height of the rear end side weight variable component 62 being substantially the same as the heights of the first rear end side grommet 52A and the second rear end side grommet 52B, can also minimize the air resistance. Furthermore, in the rear end side weight variable component 62, the rear end side weight variable component base part 62*b* having a shape that comes to intimate contact with the outer circumference of the frame 10 when the rear end side weight variable component 62 is mounted to the frame 10 also minimizes the air resistance.

Other Embodiments

A description was given in the aforementioned embodiment of the racket 1 where a tip end side weight variable component 61 could be attached. However, the racket 1 may have only the rear end side weight variable component attachment part 10*a* where the rear end side weight variable component 62 can be mounted.

Further, the rear end side weight variable component attachment part 10*a* had its position defined by the first rear end side grommet 52A and the second rear end side grommet 52B. However, the position can be defined by a single rear end side grommet. In other words, the location closest to the shaft 20 can be set as the rear end side weight variable component attachment part 10*a* without having a second rear end side grommet 52B.

Further, in the above embodiment, the configuration had the tip end side weight variable component 61 mounted on the tip end side grommet 51. However, the configuration may have the tip end side weight variable component 61 mounted directly to the frame 10 similar to the method of mounting the rear end side weight variable component 62. Further, in the above embodiment, the configuration had the rear end side weight variable component 62 mounted directly to the frame 10. However, the configuration may have the rear end side weight variable component 62 mounted on the grommet similar to the method of mounting the tip end side weight variable component 61.

The above embodiments are to facilitate understanding of the present invention, and are not to limit the present invention in any way. The present invention can be changed or modified without departing from the scope thereof, and it is needless to say that the present invention includes its equivalents.

In other words, the aforementioned embodiment was described taking an example of the racket 1 that did not have a string tensely provided to the frame 10; however, it is a matter of course that a racket 1 having a string strung can be used.

Further, any racket 1 will do as long as the rear end side weight variable component attachment part 10*a* is included and it is within the range of the present embodiment even if the rear end side weight variable component 62 is not attached to the rear end side weight variable component attachment part 10*a*.

Description was given in the aforementioned embodiment of taking a badminton racket as an example of the racket. However, the application of the aforementioned technology is not limited to badminton rackets. The technology can be applied to, for example, rackets for tennis, squash and the like.

What is claimed is:

1. A racket comprising:

a grip;

an annular frame that is provided with a plurality of through holes that penetrate from an inner circumferential face to an outer circumferential face; and a shaft that connects the grip and the frame in a shaft axis direction, the frame having:

two rear end side weight variable component attachment parts, disposed on the outer circumferential face of the frame and on a side closer to the shaft in the shaft axis direction, where there are respectively mounted at different positions on the outer circumferential face two rear end side weight variable component attachments through which a tensioned string is routed, and where the two rear end side weight variable component attachments are made of a material different from the frame, and two tip end side weight variable component attachment parts, disposed on the outer circumferential face of the frame and one a side opposite the side closer to the shaft in the shaft axis direction, where there are respectively mounted at different positions on the outer circumferential face two tip end side weight variable components through which a tensioned string is routed, and where the two tip end side weight variable components are made of a material different from the frame, wherein a shortest distance to each of the rear end side weight variable component attachment parts from a center line of the racket being shorter than a shortest distance to each of the tip end side weight variable component attachment parts from the center line, the center line extending along the shaft axis direction.

2. A racket according to claim 1, wherein the rear end side weight variable component attachment part includes at least two through holes among the plurality of through holes and the at least two through holes are formed to allow protrusions inserted therethrough, the protrusions being at least two protrusions provided to the rear end side weight variable component and having a string inserted therethrough.

3. A racket according to claim 1, wherein the frame has two tip end side attachment parts, disposed on the outer circumferential face of the frame and on a side opposite the side closer to the shaft in the shaft axis direction, where there are respectively mounted at different positions on the outer circumferential face two tip end side attachments through which a tensioned string is routed, and where the two tip end side attachments are made of a material different from the frame.

4. A racket according to claim 1, further comprising a tip end side grommet on the outer circumferential face of the frame and on the side opposite the side closer to the shaft in the shaft axis direction, wherein the tip end side grommet has the tip end side weight variable component attachment part that defines the location where the tip end side weight variable component is to be mounted.

5. A racket according to claim 4, wherein the tip end side grommet includes an engagement part that restricts a movement of the tip end side variable component in a circumferential direction of the frame.

6. A racket according to claim 1, wherein a rear end side grommet is on the outer circumferential face of the frame and on the side closer to the shaft in the shaft axis direction and the rear end side weight variable component attachment part is provided on the outer circumferential face of the frame and between the rear end side grommet and the shaft.

* * * * *